US006427255B1

(12) United States Patent
Duncan

(10) Patent No.: US 6,427,255 B1
(45) Date of Patent: Aug. 6, 2002

(54) REMOTE CONTROLLED STOPPER DEVICE

(76) Inventor: Scott Duncan, 3515 Plantain Ct., Santa Rosa, CA (US) 95403

( * ) Notice: Subject to any disclaimer, the term of this patent is extended or adjusted under 35 U.S.C. 154(b) by 0 days.

(21) Appl. No.: 09/896,620

(22) Filed: Jun. 28, 2001

(51) Int. Cl.[7] ..... A47K 1/14
(52) U.S. Cl. ..... 4/295; 138/89; 251/61.1
(58) Field of Search ..... 4/295, 293, 287, 4/286, 688, 693; 138/89, 93; 251/61.1

(56) References Cited

U.S. PATENT DOCUMENTS 2,773,619 A * 12/1956 Moeller ..... 4/295
4,565,222 A * 1/1986 Lundman ..... 138/93

* cited by examiner

*Primary Examiner*—Charles E. Phillips

(57) ABSTRACT

A stopper device for selectively blocking a drain to the passage of water. The drain is provided with an inlet, an outlet and a substantially cylindrical throat between said inlet and outlet. A controllably expandable bladder is located within the cylindrical throat which is sized and positioned such that when the bladder is compressed, the drain is selectively blocked to the passage of water and when the bladder is extended, the drain is selectively opened to the passage of water.

6 Claims, 1 Drawing Sheet

REMOTE CONTROLLED STOPPER DEVICE

TECHNICAL FIELD OF THE INVENTION

The present invention involves a stopper device for selectively blocking a drain to the passage of water which employs a bladder rather than conventional mechanical linkages. Such devices are more convenient to use than stoppers of the prior art. Specifically, the stopper device is capable of selectively blocking a drain to the passage of water and thus acts as a stopper for the drain which is capable of being manipulated remotely from the drain site.

BACKGROUND OF THE INVENTION

Typical lavatories employ a pop-up linkage for mechanically blocking the drain thus acting as a stopper to selectively retain waste water. This linkage consists of four intersecting sharp abrasive surfaces that are generally not shielded or covered. These linkages tend to loosen over time and provide a user with a control mechanism which is prone to breakdown and misalignment. In addition, such an assembly fails to comply with the Americans With Disabilities Act as Sec. 4.19.4 of the Act mandates that "there shall be no sharp or abrasive edges or elements under the lavatory."

Further, in order to actuate the typical pop-up linkage as described above, one is required to generally reach beyond the normally provided water service control handle to grasp a vertically extending rod and to pull the rod upwards until the linkage acts to seat a stopper within the drain opening to which it is appended. Although the typically provided pop-up assembly is usable by the average person, even with the above-noted non-complying linkage, it would fail to comply with other requirements of the Americans With Disabilities Act. Specifically, Section 4.27.4 of the Act requires that controls and operating mechanisms be operable with one hand and do not require tight grasping, pinching or twisting of the wrist for actuation. The Act further provides that the force required to activate controls shall be no greater than five pounds per square foot. The typical pop-up linkage employed universally in the current plumbing trade meets none of these requirements. Many disabled individuals are incapable of grasping a vertically extending rod while providing sufficient grasping and pulling effort to successfully seat a stopper within a drain pipe through the linkage so provided. Further, even for lavatories having the mandated clearance for wheelchair access, the above noted linkage and its characteristic sharp edges can cause injury to a user.

In addition to the pop-up linkage found in lavatories, the trip lever employed in bath tub installations and basket strainers used in sinks also fail to comply with the Americans With Disabilities Act. Specifically, the bath tub trip lever which moves up and down controls water accumulation in the tub. Section 4.20.5 of the Act states, in part, that "all controls must be located at the foot of the tub, near the front edge of the wall, and below the grab bar. . . ." Current trip levers are never so located; but the present invention can be so situated to meet the requirements of the Act. As to sink basket strainers, the Act states, in part, in Section 4.27.4, that actuation is limited to "5 lbs max. force." Certainly, as to a sink full of water, more than 5 lbs. force is required to remove the strainer basket against the retained water pressure in order to free the drain for waste water release. The present invention can also make sink drain assemblies compliant with the Act. Specifically the ADA looks to a "closed fist" as the standard for operating a sink. It is noted that current kitchen sinks require that baskets be pulled from the drain opening to release waste water. Thus, current kitchen drains would not comply with ADA requirements but the present invention would.

As noted above, the Act also prohibits linkages having sharp edges and corners from extending below a wall-hung seat assembly for those who are wheelchair-bound may very well injure their knees and legs when the wheelchair is brought proximate to the wall-hung sink.

In addition to, the first time, providing a stopper device which complies with the requirement of the Americans With Disabilities Act, it was an object of the present invention to provide a drain stopper which presents to a user a more elegant approach to selectively blocking the passage of waste water from a sink or tub facility.

It is a further object of the present invention to provide a stopper device for selectively blocking a drain to the passage of water which is capable of being employed by the disabled and which, as a consequence, meets the requirements of the Americans With Disabilities Act.

These and further objects will be more readily apparent when considering the following disclosure and appended claims.

SUMMARY OF THE INVENTION

The present invention is directed to a stopper device for selectively blocking a drain to the passage of water. The drain is provided with an inlet and outlet and a substantially cylindrical throat between the inlet and outlet. The controllably expandable bladder is located within the cylindrical throat which is sized and positioned such that when the bladder is compressed, the drain is selectively blocked to the passage of water and when the bladder is extended, the drain is selectively opened to the passage of water.

DETAILED DESCRIPTION OF THE INVENTION

Figure 1:
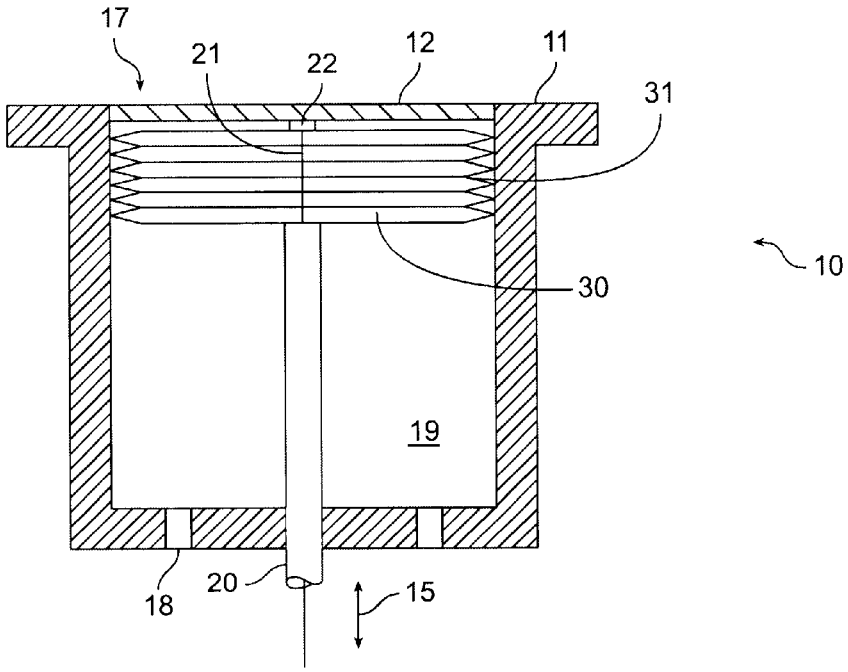
FIGS. 1 and 2 are illustrations of the present invention in partial cross-section showing the drain in a selectively blocked and selectively open orientation, respectively.

Turning to FIG. 1, drain assembly 10 shown in partial cross-section is generally provided with strainer 12 and open throat region 19. Drain 10 is provided with inlet 17 covered by strainer 12 and outlets 18 through which waste water passing through drain 10 is fed to a suitable municipal sewer system.

In the typical prior art installation (not shown), somewhat behind the control handle providing water service to the appropriate sink, tub or basin, would generally be provided a pop-up rod which, when pulled vertically, acts upon a linkage generally provided behind a lavatory for drawing a plunger within drain 10 for selectively retaining waste water therein. However, such pop-up assembly is not only loosened as a result of their linkage but are difficult to manipulate by those who are handicapped. As an alternative, the present invention is provided.

Figure 2:
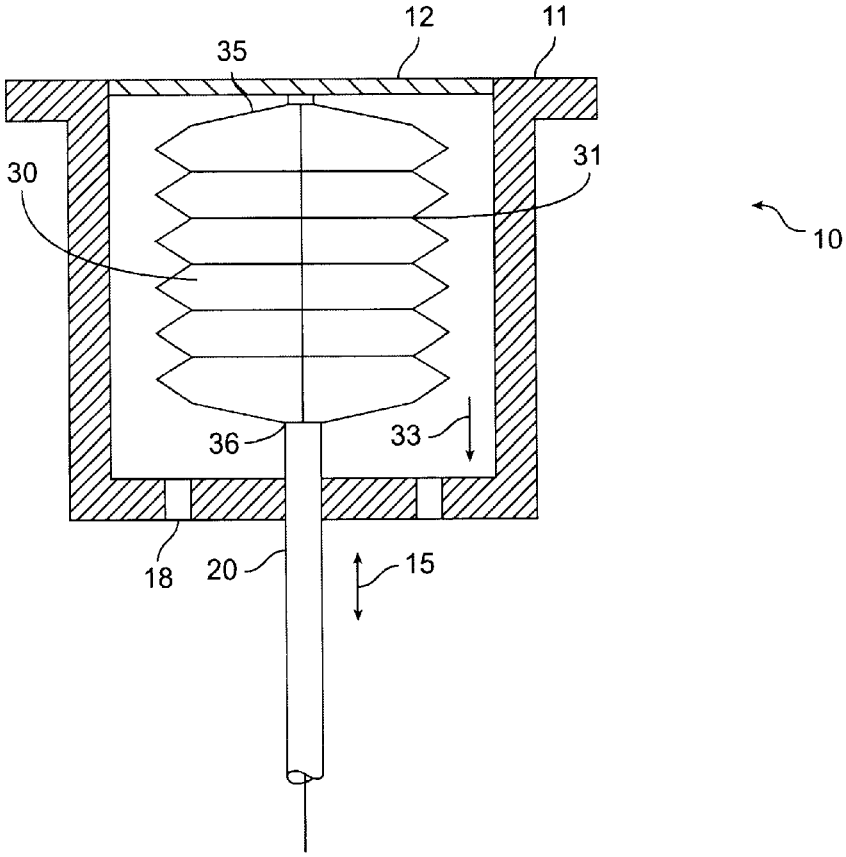

Turning again to FIG. 1, within the cylindrical throat region 19 of drain 10 is provided a controllably expandable bladder 30. As a preferred embodiment, bladder 30 comprises a membrane having a series of fold joints 31 such that when compressed, the bladder compresses along the fold joints to assume an accordion-like configuration as shown in FIG. 1. As noted by comparing FIGS. 1 and 2, when controllably expandable bladder 30 having upper surface 35 and lower surface 36 is compressed such that the upper and lower surfaces are drawn together, bladder 30 extends over the entire cross-section of drain 10 thus blocking drain 10 to the passage of water (FIG. 1). However, when upper surface 35 and lower surface 36 are drawn away from one another, bladder 30 is extended thus reducing its cross-sectional area and freeing drain 10 to the passage of waste water as depicted by directional arrows 33.

It is noted that not only does the present invention eliminate the need for a pop-up rod and mechanical linkage, it has the further advantage of enabling drain 10 to selectively open and close to the passage of waste water from a position remote from the drain itself. Ideally, this is accomplished by providing wire mandrel 21 and tubular jacket 20 as depicted. Specifically, wire mandrel 21 can be permanently affixed to top surface 35 at attachment point 22. Tubular jacket 20 surrounds wire mandrel 22 and is capable of moving back and forth as depicted by directional arrows 15. In that tubular jacket 20 is permanently fixed to lower surface 36, as tubular jacket 20 moves in the direction of arrow 15, drain 10 can be selectively opened and closed depending upon the state of compression of controllably expandable bladder 30.

Bladder 30 can be composed of various forms of rubber or plastic, the only requirements being that, as a preferred embodiment, fold joints 31 are maintained and sufficient rigidity is realized to enable bladder 30 to block the passage of waste water through drain 10 when compressed.

Through the practice of the present invention, one is able to provide a stopper device for selectively blocking a drain which does not require grabbing onto a pop-up rod or similar mechanical expedient which, as noted previously, not only provides unacceptable challenges to the handicapped, but fails to meet the requirements of the Americans With Disabilities Act. In addition, the present invention provides an elegant alternative to prior art mechanical linkages which are fraught with difficulties as the linkage loosens over time.

I claim:

1. A stopper device for selectively blocking a drain to the passage of water, said drain having an inlet, an outlet, and a substantially cylindrical throat between said inlet and outlet, a controllably expandable bladder located within said cylindrical throat which is sized and positioned such that when said bladder is compressed, said drain is selectively blocked to the passage of water and when said bladder is extended, said drain is selectively opened to the passage of water therethrough, said bladder comprising a membrane having a series of fold joints such that when compressed, said bladder compresses along said fold joints to assume an accordion-like configuration.

2. A stopper device for selectively blocking a drain to the passage of water, said drain having a strainer serving as an inlet, an outlet, and a substantially cylindrical throat between said inlet and outlet, a controllably expandable bladder located within said cylindrical throat which is sized and positioned such that when said bladder is compressed, said drain is selectively blocked to the passage of water and when said bladder is extended, said drain is selectively opened to the passage of water therethrough.

3. The stopper device of claim 2 wherein said bladder is provided with an upper surface and lower surface, said upper and lower surfaces being drawn together when said bladder is compressed.

4. The stopper device of claim 3 wherein said controllably expandable bladder is provided with a terminal end of a wire mandrel on its upper surface and a tubular jacket through which said wire mandrel extends on its lower surface such that said tubular jacket is movable along said wire mandrel.

5. The stopper device of claim 4 wherein said terminal end of said wire mandrel is fixed to said upper surface and said tubular jacket is fixed to said lower surface such that as said tubular jacket moves along said wire mandrel towards said upper surface, said bladder is compressed and as said tubular jacket moves along said wire mandrel away from said upper surface, said bladder is extended.

6. The stopper device of claim 5 wherein movement of said tubular jacket is actuated from a location remote from said drain.

* * * * *